US007596871B1

(12) United States Patent
Nilsson

(10) Patent No.: US 7,596,871 B1
(45) Date of Patent: Oct. 6, 2009

(54) ADJUSTABLE TOOL

(75) Inventor: Robert J. Nilsson, New Hartford, CT (US)

(73) Assignee: A.N. Designs, Inc., Torrington, CT (US)

( * ) Notice: Subject to any disclaimer, the term of this patent is extended or adjusted under 35 U.S.C. 154(b) by 136 days.

(21) Appl. No.: 10/928,290

(22) Filed: Aug. 27, 2004

(51) Int. Cl.
*B25G 3/00* (2006.01)

(52) U.S. Cl. ..... 30/329; 30/340; 30/342

(58) Field of Classification Search ..... 30/168, 30/286, 125, 329–342, 162; D15/140
See application file for complete search history.

(56) References Cited

U.S. PATENT DOCUMENTS

| | | | | | |
|---|---|---|---|---|---|
| 242,985 | A | | 6/1881 | Rischow | |
| 1,398,207 | A | | 11/1921 | Thrailkill | |
| 1,424,433 | A | | 8/1922 | Angeletti | |
| 1,493,372 | A | | 5/1924 | Moon | |
| 1,583,967 | A | * | 5/1926 | Epps, Jr. | 30/339 |
| 1,863,108 | A | * | 6/1932 | Glenzer | 279/49 |
| 1,951,393 | A | * | 3/1934 | Castroviejo | 30/336 |
| 2,236,781 | A | * | 4/1941 | Pannier | 269/60 |
| 2,438,797 | A | * | 3/1948 | Bagge | 279/51 |
| 2,465,433 | A | * | 3/1949 | Doniger | 30/336 |
| 2,482,385 | A | * | 9/1949 | Urban et al. | 30/329 |
| 2,507,872 | A | * | 5/1950 | Unsinger | 30/336 |
| 2,599,174 | A | * | 6/1952 | Hauser | 269/228 |
| 2,605,545 | A | * | 8/1952 | Weems | 30/337 |
| 2,619,724 | A | * | 12/1952 | Manthey et al. | 30/336 |
| 2,683,931 | A | * | 7/1954 | Fahlgren | 30/329 |
| 2,737,069 | A | | 3/1956 | Weindel, Jr. | |
| 3,041,724 | A | | 7/1962 | Bobkowski | |
| 3,217,410 | A | * | 11/1965 | Matwijcow | 30/338 |
| 3,217,519 | A | * | 11/1965 | Demler | 72/19.7 |
| 3,345,743 | A | | 10/1967 | Paulson et al. | |
| 3,448,517 | A | * | 6/1969 | Cothery | 30/140 |
| 3,521,686 | A | * | 7/1970 | Weinmann | 30/517 |
| 3,549,159 | A | * | 12/1970 | Kroener | 279/53 |
| 3,977,079 | A | * | 8/1976 | Rebold | 30/336 |
| 4,215,871 | A | * | 8/1980 | Hirsch et al. | 279/48 |
| 4,525,144 | A | * | 6/1985 | Fritz | 433/118 |
| 4,713,885 | A | | 12/1987 | Keklak et al. | |

(Continued)

OTHER PUBLICATIONS

UltraWiz Auto Glass Tools brochure, "The tools professionals prefer for efficient glass removal."

(Continued)

*Primary Examiner*—Jason Daniel Prone
(74) *Attorney, Agent, or Firm*—Cantor Colburn LLP

(57) ABSTRACT

A cold knife (10) has a handle (12) within which a receiver bore (34) extends longitudinally. A split collet (38) is slidably mounted within the bore (34) and is configured to receive within a shank groove (40), at any desired longitudinal position therein, the shank (14*a*) of a cutting blade (14). Because the shank (14*a*) may thus be selectively positioned relative to split collet (38), cutting blade (14) may be positioned in infinitesimally small increments at a desired degree of extension relative to the cold knife (10). Terminal end (14*c*) of cutting blade (14) may thus be positioned anywhere from and between extreme positions ($P_1$ and $P_3$) when shank (14*a*) is clamped within split collet (38) by locking lever (22) moving split collet (38) to place the nose portion (38*c*) thereof into compressed engagement with reduced-diameter stop portion (34*c*) of the receiver bore (34).

24 Claims, 5 Drawing Sheets

U.S. PATENT DOCUMENTS

| | | | | | |
|---|---|---|---|---|---|
| 4,998,842 | A | * | 3/1991 | Sheridan | 52/646 |
| 5,063,672 | A | * | 11/1991 | Grois et al. | 30/272.1 |
| 5,071,426 | A | | 12/1991 | Dolgin et al. | |
| 5,169,079 | A | * | 12/1992 | Renzetti | 43/1 |
| 5,400,510 | A | * | 3/1995 | Glodowski | 30/298 |
| 5,426,855 | A | | 6/1995 | Keklak et al. | |
| 5,575,071 | A | * | 11/1996 | Phillips et al. | 30/392 |
| 5,782,853 | A | * | 7/1998 | Zeevi et al. | 30/329 |
| 5,784,788 | A | * | 7/1998 | Cothery | 30/294 |
| 5,876,912 | A | * | 3/1999 | Crawley et al. | 430/558 |
| 6,256,889 | B1 | * | 7/2001 | Zuro | 30/339 |
| 6,725,548 | B1 | | 4/2004 | Kramer et al. | |
| D544,507 | S | * | 6/2007 | Crouch | D15/140 |
| 7,308,763 | B2 | * | 12/2007 | Glodowski | 30/339 |

OTHER PUBLICATIONS

Equalizer 2003 Catalog, "Auto Glass Removal & Replacement Products", pp. 20-33.

* cited by examiner

ADJUSTABLE TOOL

BACKGROUND OF THE INVENTION

1. Field of the Invention

The present invention generally concerns a tool, such as a knife, having a replaceable and selectively positionable tool accessory, such as a blade. In particular, the present invention is applicable to knives which are useful to remove broken or damaged vehicle windshields. Such removal is attained by using the knife to cut the sealant or bonding material, usually a polyurethane material, which engages the peripheral edge of the windshield to retain it in an opening in the vehicle. Such knives are usually referred to in the art as cold knives.

2. Related Art

Cold knives are well known in the art as exemplified by a sales brochure published by A.N. Designs, Inc., of Torrington, Conn., entitled "UltraWiz Auto Glass Tools". In addition, see pages 20-33 of the 2003 catalog of Equalizer Industries, Inc. of Round Rock, Tex. Generally, knives with removable and replaceable blades are well known in the art.

SUMMARY OF THE INVENTION

Generally, in accordance with the present invention there is provided a tool, for example, a knife, such as a cold knife or a long knife, the tool having a replaceable tool accessory, such as a cutting blade, carried in a split collet which is movable within a handle. The split collet is mounted in the handle and is configured to hold the tool accessory at a selected length of extension of the blade from the handle, the selected length being adjustable in infinitesimally small increments.

Specifically, in accordance with the present invention there is provided a tool comprising the following components. A handle has therein a receiver bore having a longitudinal axis, the bore communicating with a stop member, which stop member optionally may comprise a reduced-diameter portion of the receiver bore. A split collet is disposed and configured for movement, e.g., slidable movement within the receiver bore along the longitudinal axis thereof, and has a shank groove which is configured to be compressible along at least a portion of its length. The split collet is also disposed and configured to receive therein a shank of a tool accessory at a selected position which is adjustable in infinitesimally small increments relative to the shank groove by moving, e.g., sliding, such shank along the shank groove. An actuating member is mounted on the handle and is operatively connected to the split collet to move the split collet within and along the longitudinal axis of the receiver bore, in order to force the split collet into engagement with the stop member to compress at least part of the shank groove. In this way, such shank is clamped in place within the shank groove at a selected protrusion of the tool accessory from the handle.

In one aspect of the invention, the tool may have the tool accessory mounted therein.

Another aspect of the invention provides for the tool to further comprise a resilient member disposed between the split collet and the locking lever, which resilient member is compressed upon movement of the locking lever to its locked position and which expands upon movement of the locking lever to its unlocked position.

Another aspect of the present invention provides a knife comprising the following components. A handle has therein a receiver bore having a longitudinal axis, the receiver bore terminating in a reduced-diameter portion comprising a stop member. A split collet is configured for slidable movement within the receiver bore along the longitudinal axis thereof, and has therein a shank groove which defines at least two split segments of the split collet, the shank groove being configured to receive therein a shank of a knife blade at a selected position which is adjustable in infinitesimally small increments relative to the shank groove by sliding such shank along the shank groove. An actuating member comprising a locking lever is mounted on the handle and is movable between a locked position in which such knife blade is locked in place within the handle, and an unlocked position in which such knife blade is freed for movement relative to the handle, including disengagement from the handle. The locking lever is operatively connected to the split collet to move the split collet along the longitudinal axis of the receiver bore to force the split collet into engagement with the stop member and to compress at least part of the split segments and thereby clamp such shank in place within the shank groove. The shank is clamped in place at a selected protrusion of the knife blade from the handle, when the locking lever is moved to its locked position.

Other aspects of the present invention provide that the knife further comprises a resilient member as described above, and a split collet configured as described above.

Another aspect of the present invention provides for the above-described knife to have a knife blade mounted therein.

DETAILED DESCRIPTION OF THE INVENTION AND EMBODIMENTS THEREOF

Figure 1:
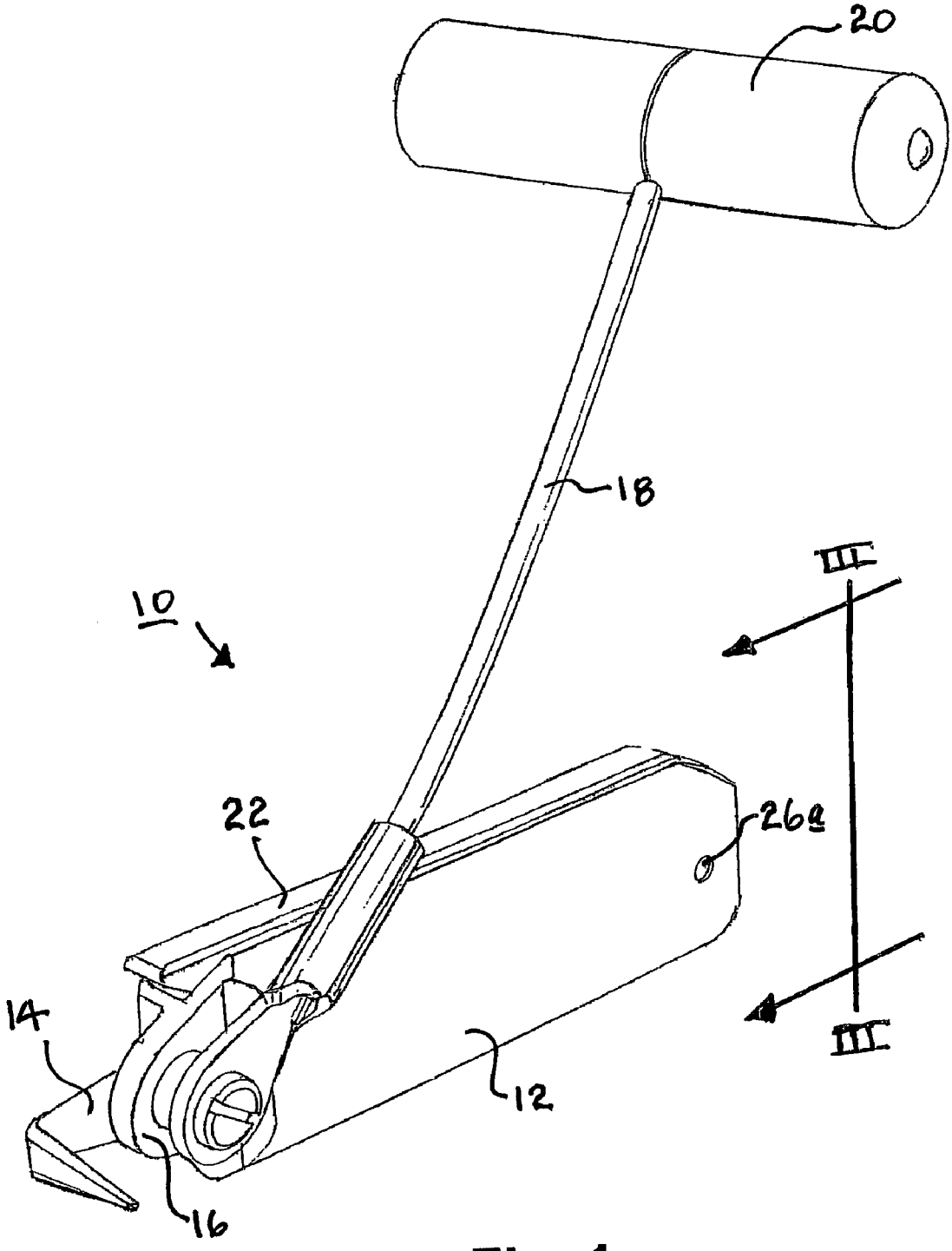
FIG. 1 is a perspective view of a cold knife in accordance with one embodiment of the present invention.

FIG. 1 is a perspective view of a cold knife 10 comprised of a handle 12 within which a cutting blade 14 is mounted. A cable attachment 16 is mounted on handle 12 at the end thereof adjacent cutting blade 14 and has connected thereto a pull cable 18 which terminates in a pull handle 20. The foregoing arrangement of parts is conventional and well known in the art.

Figure 2:
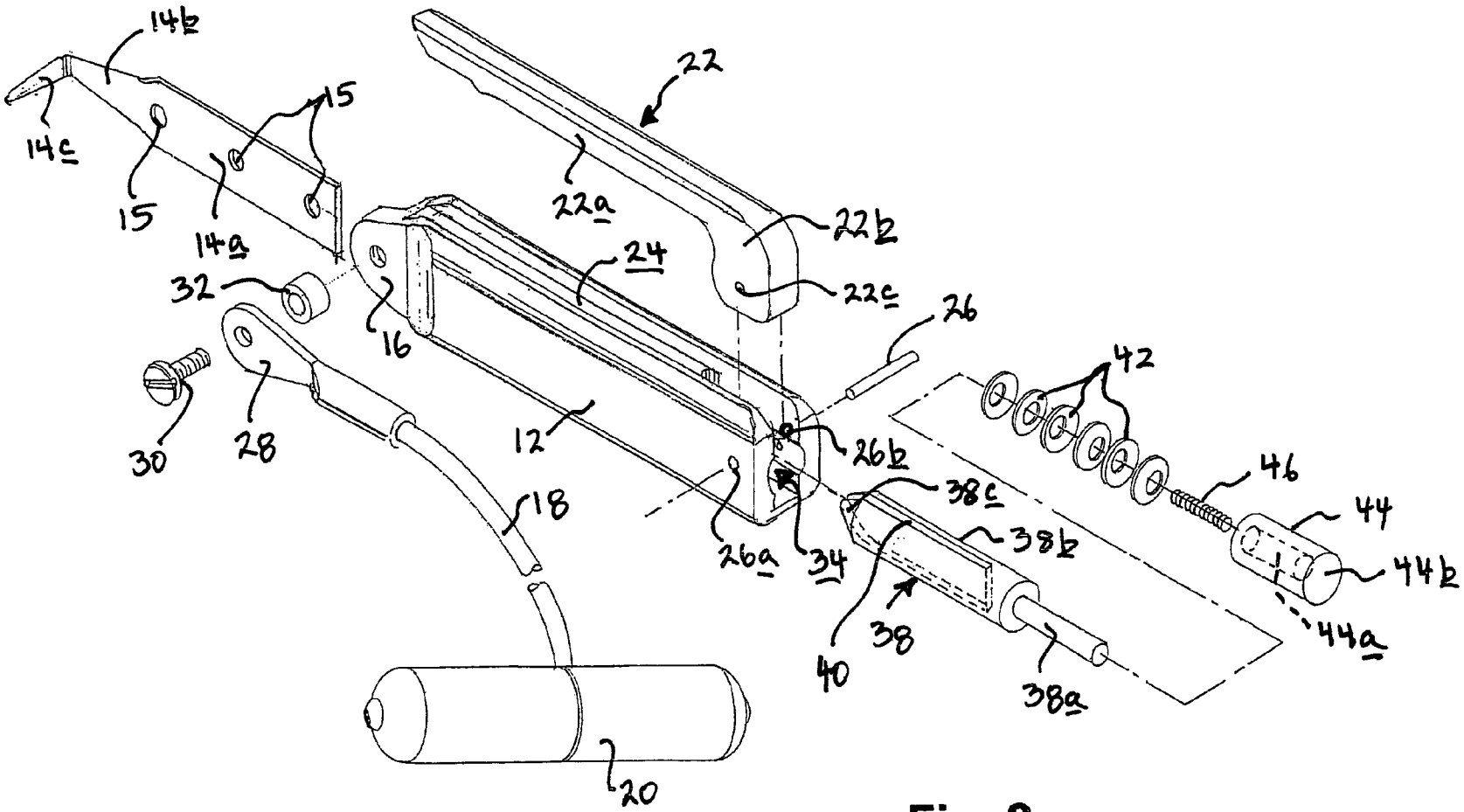
FIG. 2 is an exploded view of the cold knife of FIG. 1.

There is mounted on handle 12 a locking lever 22, most of which is received within a groove 24 (unnumbered in FIG. 1; best seen in FIGS. 2, 3, 4 and 7), and which pivots about a pivot pin 26, best seen in FIG. 2.

Referring now to FIG. 2, cutting blade 14 is conventionally configured and has a shank 14*a* of generally flat, rectangular configuration, a transition piece 14*b*, and a transverse terminal end 14*c*. Terminal end 14*c* projects at a right angle from the longitudinal axis of shank 14*a* and transition piece 14*b*. Shank 14*a* has formed therein three holes 15. Cutting blade 14, including holes 15, is conventional and well known in the art. The holes 15 have utility in prior art knives in which the selected length of extension of cutting blade 14 from the handle may be selected in any one of three lengths, a set screw or spring-loaded detent member serving to engage a selected one of the three holes 15. Holes 15 serve no function in the knives of the present invention, but are illustrated in FIG. 2 to show that existing conventional cutting blades may be utilized in the knives of the present invention.

It will be appreciated that cutting blade 14 could be made without the holes 15 and as such would be entirely suited for use in connection with the knives of the present invention, but would not be usable in prior art knives utilizing a set screw, spring-loaded detent or other such means to retain the cutting blade in any one of three selected lengths of extension from the handle.

The proximal end of pull cable 18 has affixed thereto a mounting collar 28 which is affixed to cable attachment 16 by means of a set screw 30 and its spacer collar 32. This arrangement for securing pull cable 18 to handle 12 is conventional and well known in the art.

Locking lever 22 is comprised of a longitudinally extending operating bar 22*a* and a cam 22*b*. A transverse bore 22*c* is formed in cam 22*b* and is dimensioned and configured to receive pivot pin 26 therein. Pivot pin 26 is received at its opposite ends within mounting holes 26*a*, 26*b* formed in handle 12. Mounting holes 26*a*, 26*b* are in alignment with each other and are formed in handle 12 on opposite sides of receiver bore 34, shown in FIG. 2, but best seen in FIGS. 3 and 4.

Figure 6:
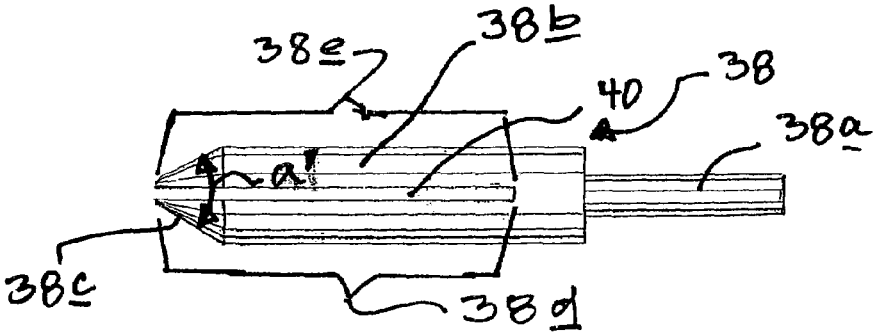
FIG. 6 is a top view of the split collet, also shown in FIG. 2, of the cold knife of FIG. 1.

FIGS. 2 and 6 show the split collet 38 of cold knife 10 comprised of an extension stem 38*a*, a body portion 38*b* and a nose portion 38*c*. A shank groove 40 is parallel to the receiver bore 34 and extends through all of nose portion 38*c* and most of body portion 38*b*, and divides the entire length of nose portion 38*c* and at least a portion of the length of body portion 38*b* into two split segments 38*d* and 38*e*. In the illustrated embodiment, shank groove 40 is of rectangular cross section. If desired, the split segments 38*d*, 38*e* may themselves be longitudinally split to increase their flexibility and commensurately increase their compressibility. For example, each of the two split segments 38*d*, 38*e* may be longitudinally split from the tip of nose portion 38*c* for at least a portion of their length to provide four (or more) split segments (not shown).

Referring to FIG. 2, a plurality of perforated, cup-shaped belleville springs 42 are dimensioned and configured to be mounted upon extension stem 38*a* and held in place thereon by a drive piston 44. Drive piston 44 has a piston bore 44*a* formed therein within which a coil spring 46 is mounted, and an end face 44*b*. Coil spring 46 is received within piston bore 44*a*, and belleville springs 42 are mounted upon extension stem 38*a* and held thereon by engagement of piston 44 with extension stem 38*a*. Such engagement may be effectuated by any suitable means, e.g., by external threads (not shown) on extension stem 38*a* and complementary internal threads (not shown) within piston bore 44*a*, or by any other suitable mechanical means (not shown).

Figure 4:
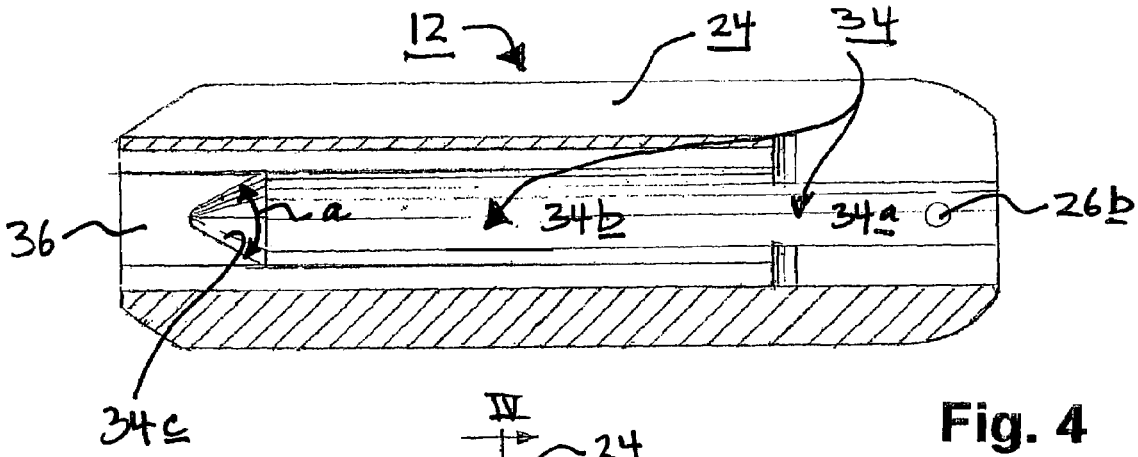
FIG. 4 is a longitudinal cross-sectional view taken along line IV-IV of FIG. 3.
Figure 3:
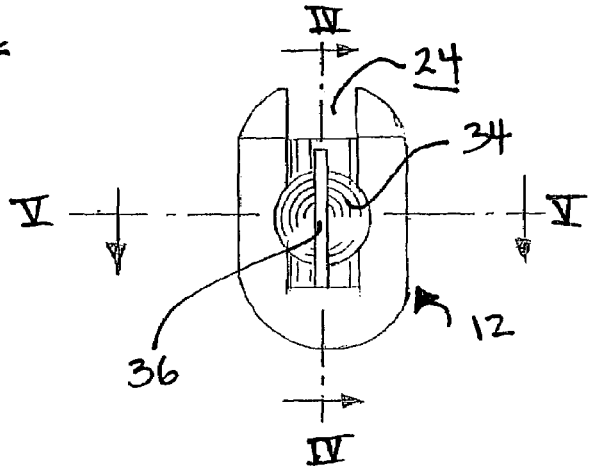
FIG. 3 is an end view taken along line III-III of FIG. 1, with parts omitted.
Figure 5:
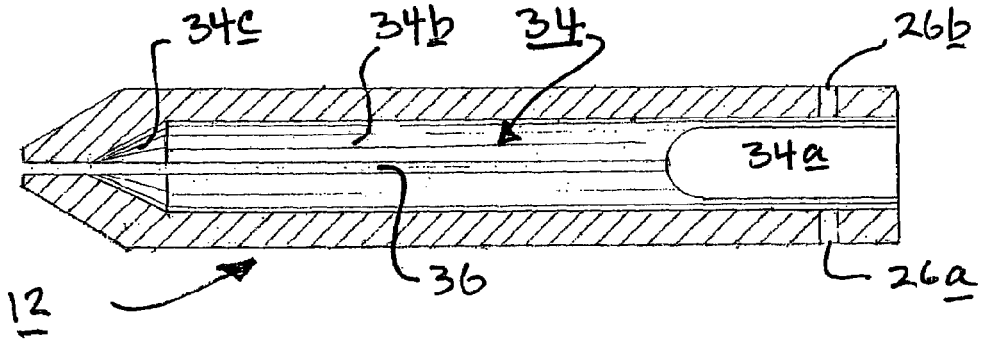
FIG. 5 is a longitudinal cross-sectional view taken along line V-V of FIG. 3.

Referring now to FIGS. 3, 4 and 5, receiver bore 34 has a stem portion 34*a*, a central portion 34*b* and a stop portion 34*c*. Stop portion 34*c* of bore 34 is seen to be of generally conical shape, slightly truncated at its terminal end. Stop portion 34*c* is in communication with a knife slot 36, which is a thin, rectangular-shaped slot extending to and through the end of handle 12 on which cable attachment 16 (FIG. 2) is affixed. The nose portion 38*c* faces the generally conical-shaped stop portion 34*c* at the front end of the receiver bore 34.

Stop portion 34*c* of receiver bore 34 and nose portion 38*c* of split collet 38 are respectively dimensioned and configured so that forcing nose portion 38*c* into stop portion 34*c* will compress the split segments 38*d*, 38*e* of split collet 38 to firmly grip therebetween the shank 14*a* of cutting blade 14. For example, stop portion 34*c* may have at any point along its length a diameter which is slightly less than the uncompressed diameter of the corresponding point along the length of nose portion 38*c*.

Alternatively, or in addition, the longitudinal length of stop portion 34*c* may be slightly smaller than the longitudinal length of nose portion 38*c* or the apex angle a (FIG. 4) of stop portion 34*c* may be slightly smaller than the uncompressed apex angle a' (FIG. 6) of nose portion 38*c*. The small difference in respective, corresponding-point diameters of nose portion 38*c* and stop portion 34*c* will, as described below, compress the split segments (halves in the illustrated embodiment) when split collet 38 is forced leftwardly, as viewed in FIGS. 4 and 5, to the apex of stop portion 34*c* of receiver bore 34. In this way, at least a portion of the split segments defining shank groove 40 are forced together, to tightly grip the shank 14*a* of cutting blade 14. The particular construction utilized will determine the portion of the length of shank groove 40 which is compressed to grip shank 14*a*.

Generally, it is seen that one end of the locking lever 22 is pivotably mounted to the handle 12 and is dimensioned and configured as a cam 22*b* which is operatively associated with, e.g., disposed adjacent to, the drive end of split collet 38, i.e., the end which is opposite to nose portion 38*c*, whereby pivoting of the locking lever 22 to its locked position forces the split collet 38 forward (towards stop portion 34*c*) by a camming action.

FIGS. 7, 7A and 8, 8A illustrate installing in a tool member comprising an embodiment of the present invention (e.g., cold knife 10, see FIG. 1) a tool accessory (e.g., cutting blade 14) at a selected extension from the tool accessory end of the tool member.

Figure 7:
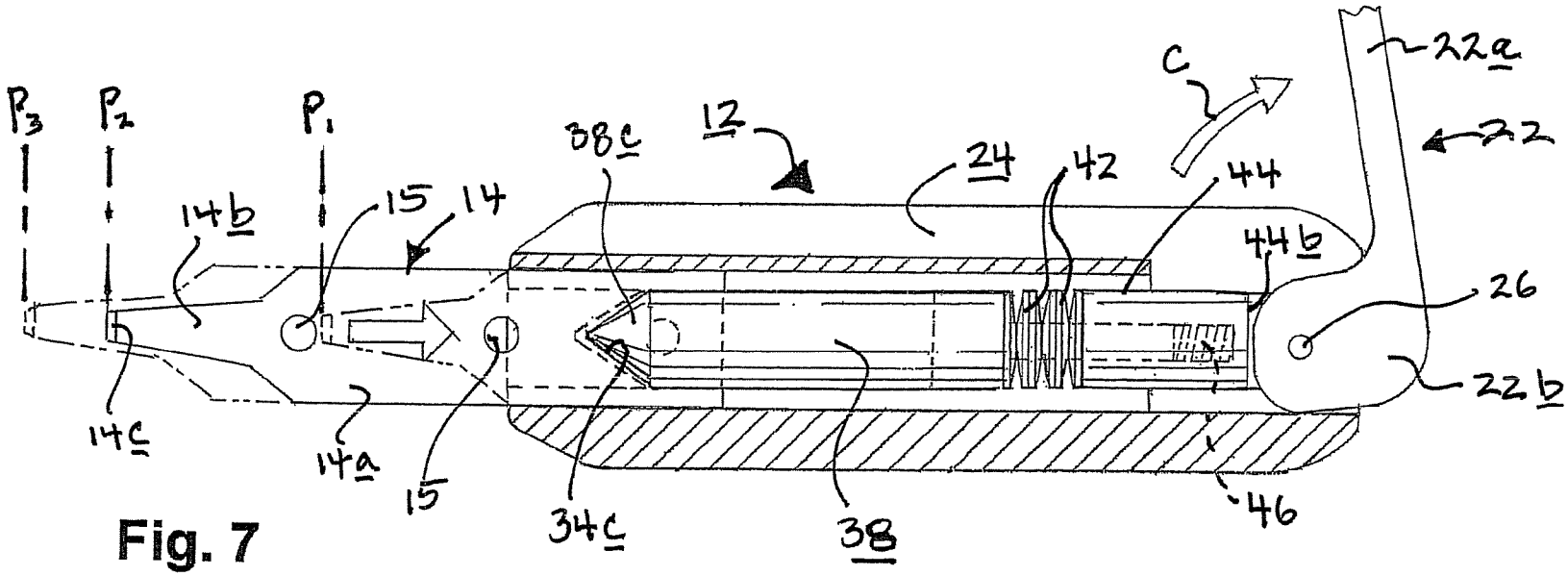
FIG. 7 is a side elevation cross-sectional view taken along the longitudinal axis of the handle of the cold knife of FIG. 1 showing the locking lever in its open, blade-release position and with a cutting blade mounted in an intermediate position therein, including two phantom-line renderings of the cutting blade showing it in alternate fully-extended and fully-retracted positions.

Referring to FIG. 7, shank 14*a* of cutting blade 14 is placed within knife slot 36 of handle 12 and shank groove 40 of split collet 38, which is received within receiver bore 34, with locking lever 22 in its open, unlocked position. Belleville springs 42 and coil spring 46 are therefore expanded, and split collet 38 is not forced against stop portion 34*c* of receiver bore 34. Cutting blade 14, which may be a replacement blade or the existing blade in handle 12, may be positioned, manually or otherwise, at any desired location relative to handle 12 in order to adjust the length of extension of cutting blade 14 from handle 12. Accordingly, the user may manually adjust the desired length of protrusion, i.e., extension, of cutting blade 14 from handle 12 to position cutting blade 14 at either of two extreme positions or at any selected intermediate position between the two extreme positions.

In FIG. 7, an intermediate position $P_2$ of cutting blade 14 (measured at its terminal end 14*c*) is shown by the solid-line rendition of cutting blade 14. The extreme positions of cutting blade 14, again measured at its terminal end 14*c*, are shown in phantom outline in FIG. 7, the fully extended position at $P_3$ and the fully retracted position at $P_1$. It will be appreciated that shank 14*a* may be positioned in infinitesimally small increments at any desired position along the length of shank groove 40 of split collet 38 in any desired increments. Because there is no need to engage detents or other structures such as holes 15 of cutting blade 14 with a set screw or other positioning or securing structure, the position of cutting blade 14 may be set at any desired position in infinitesimally small increments between and including the extreme positions $P_1$ and $P_3$ illustrated in FIG. 7.

Figure 8:
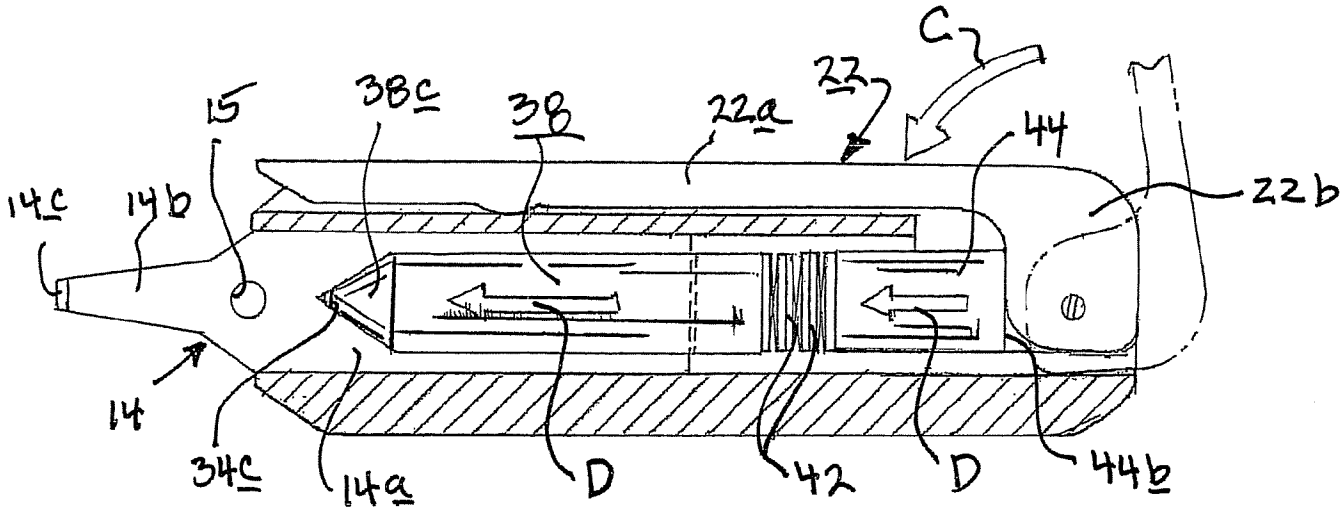
FIG. 8 is a view corresponding to that of FIG. 7 except that the blade is shown positioned in its shortest possible extension from the handle and the locking lever is shown in its locked, blade-retaining position.
Figure 8A:
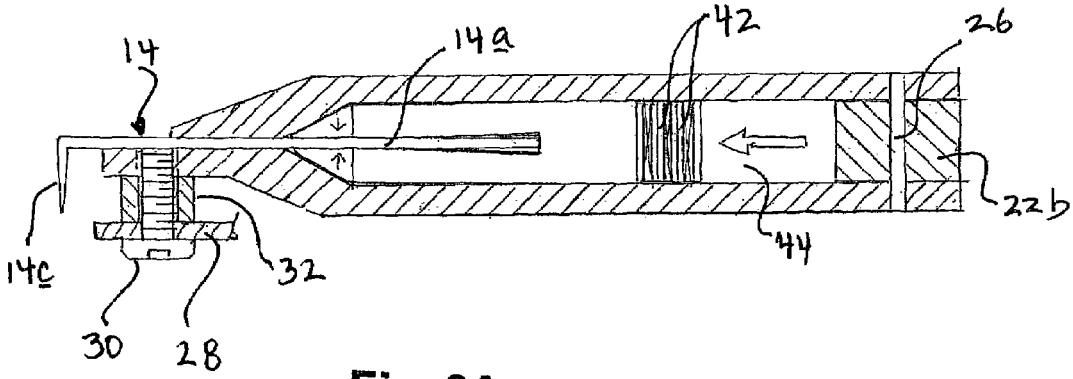
FIG. 8A is a view corresponding to that of FIG. 7A, with the blade and locking lever in the same positions as in FIG. 8.

The only constraint on positioning shank 14*a* within shank groove 40 to attain the fully extended position $P_3$ for a cutting blade 14 of given length, is that enough of shank 14*a* must be retained within shank groove 40 to firmly clamp cutting blade 14 in place. The only constraint to attain the fully retracted position $P_1$ of a cutting blade 14 of given length, is the length of shank groove 40. When cutting blade 14 is properly positioned, i.e., is positioned with its shank 14*a* protruding into shank groove 40 to the extent desired by the user, locking lever 22 is moved in the direction of arrow C to its locked, blade-retaining position as shown in FIGS. 8 and 8A. Upon such movement, cam 22*b* of locking lever 22 engages end face 44*b* of piston 44 to compress coil spring 46 (shown in FIG. 7 but not in FIG. 8) and belleville springs 42 and drive split collet 38 in the direction shown by arrow D into tight-fitting engagement with stop portion 34*c* of receiver bore 34. In FIG. 8, the open, blade-release position of locking lever 22 is shown in phantom outline.

Figure 7A:
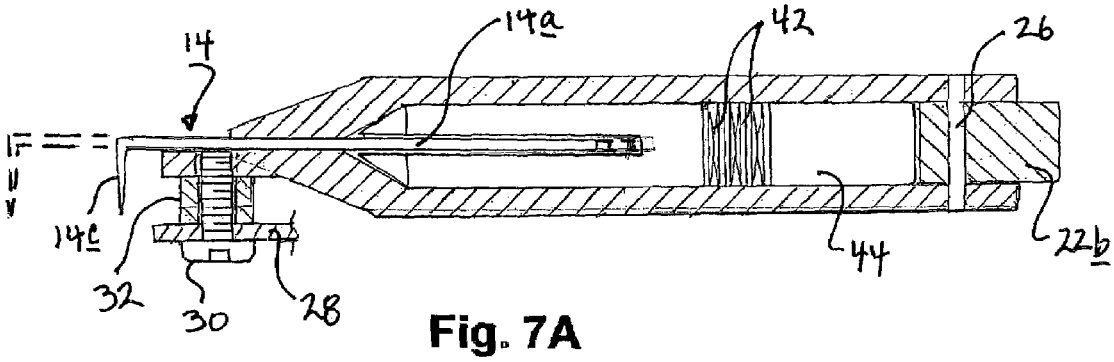
FIG. 7A is a top cross-sectional view with parts broken away taken along the longitudinal axis of the handle of the cold knife of FIG. 1, showing the locking lever in the position illustrated in FIG. 7.

Because, as described above, the uncompressed diameters of nose portion 38*c* of split collet 38 are slightly greater than the corresponding diameters of stop portion 34*c* of receiver bore 34, the movement of split collet 38 towards stop portion 34*c* compresses the split segments (halves) of nose portion 38*c* and firmly grips the shank 14*a* of cutting blade 14 therebetween, regardless of the selected appropriate position of cutting blade 14 relative to handle 12. An "appropriate" position is one which meets the constraint noted above, that enough of shank 14*a* is gripped to retain the blade (or other tool accessory) in place firmly enough for the intended use of the tool. Accordingly, cutting blade 14 may selectively be positioned at either one of the extreme positions $P_1$ and $P_3$ shown in phantom outline in FIG. 7, or at any selected intermediate position. Illustrated intermediate position $P_2$, shown in solid-line rendition in FIG. 7, is but one example of an intermediate position of cutting blade 14. FIG. 7A shows an alternate position of cutting blade 14 in phantom outline.

Generally, the split collet 38 is spring-loaded and the locking lever 22 is mounted on the handle 12 for movement between an open, blade-release position and a locked, blade-retaining position. The locking lever 22 is dimensioned and configured so that, when pivoted to its locked position, it overcomes the spring-resistance of the split collet 38 and drives the split collet towards the knife-receiving slot, whereby the conical-shaped stop portion 34*c* of the receiver bore 34 forces the split segments of the conical nose portion 38*c* of the split collet 38 together, to firmly grip the shank 14*a* of cutting blade 14 therebetween.

While the invention has been described in detail with respect to a specific cold knife embodiment thereof, it will be appreciated that it has application to other tools, including by way of example, trim knives, long knives, and other knives used or useful in connection with removing damaged windshields from vehicles. Further, the present invention is generally applicable to any knife or tool in which a projecting blade or other member is to be positioned in a selected one of a series of positions or extensions from the body of the tool. The present invention permits infinitesimally small increments of such positioning.

What is claimed is:

1. A tool member comprising:

a handle having therein a receiver bore having a longitudinal axis, the receiver bore having a lever end opening and an opposite, tool accessory end, the receiver bore comprising a stop member located at the tool accessory end of the bore and comprising a reduced-diameter portion of the bore;

a split collet disposed within the receiver bore and configured for movement within the receiver bore along the longitudinal axis thereof, the split collet having a shank groove which has a length and which faces the tool accessory end of the receiver bore and is configured to (1) have a compressible section along at least a portion of the length of the shank groove, and (2) to receive within the shank groove a shank of a tool accessory at a selected position which is adjustable in infinitesimally small increments relative to the shank groove by moving such shank along the length of the shank groove; and an actuating member comprising (a) a locking lever mounted on the handle adjacent to the lever end opening of the receiver bore and movable between a locked position and an unlocked position, and (b) a resilient member which is disposed within the receiver bore between the lever end opening thereof and the split collet, the locking lever being operative (i) when moved to the locked position to compress the resilient member and force the split collet against the stop member to compress the compressible section of the split collet to firmly clamp such shank in place within the shank groove at a selected protrusion of the tool accessory from the handle, and (ii) when moved to the unlocked position, to relieve pressure on the resilient member to permit movement of the split collet away from the stop member sufficiently to release such shank of a tool accessory for re-positioning of the tool accessory relative to the split collet or removal therefrom.

2. The tool member of claim 1 wherein the split collet and the receiver bore are so configured that the movement of the split collet is a slidable movement, and the mounting of the locking lever is so configured that the locking lever is pivotably movable between the locked position and the unlocked position.

3. The tool member of claim 1 or claim 2 having a tool accessory mounted therein, the tool accessory having a shank at least partly received within the shank groove.

4. The tool member of claim 3 wherein the shank groove and the shank of the tool accessory are configured so that the shank is slidable along the shank groove.

5. The tool member of claim 3 wherein the shank of the tool accessory is flat and the shank groove of the tool is of rectangular cross section.

6. The tool member of claim 5 wherein the shank of the tool accessory is generally rectangular and the tool accessory comprises a cutting blade.

7. The tool member of claim 3 wherein the tool accessory comprises a cutting blade.

8. The tool member of claim 7 wherein the cutting blade has a substantially flat shank and a transverse terminal end.

9. The tool member of claim 3 wherein the receiver bore terminates at the accessory end of the handle in a knife slot which extends through the stop member, the knife slot being dimensioned to prevent passage therethrough of the split collet, and the shank of the tool accessory extends through the knife slot and into the shank groove of the split collet.

10. The tool member of claim 3 wherein the locking lever further comprises a cam which is disposed at the lever end opening and which is configured to apply pressure to drive and hold the split collet against the stop member when the locking lever is moved to the locked position, and to release the pressure to permit the split collet to move away from the stop member when the locking lever is moved to the unlocked position.

11. The tool member of claim 1 or claim 2 wherein the split collet and the receiver bore are so configured that the movement of the split collet is within the receiver bore is a slidable movement.

12. The tool member of claim 1 or claim 2 wherein the resilient member comprises a belleville spring.

13. The tool member of claim 1 or claim 2 wherein the split collet further comprises an extension stem on which is mounted a drive piston disposed within the receiver bore, and the resilient member is interposed between the split collet and the drive piston.

14. The tool member of claim 13 wherein the drive piston has an end face, the locking lever is configured to define a cam disposed at the lever end opening of the receiver bore and, upon movement of the locking lever to the locked position, the cam contacts the end face of the drive piston and is configured to compress the resilient member to drive the split collet into engagement with the stop member, and to relieve compression on the resilient member upon movement of the locking lever to the unlocked position.

15. The tool member of claim 1 or claim 2 wherein the shank groove extends parallel to the receiver bore.

16. A tool member comprising:

a handle having therein a receiver bore having a longitudinal axis, the receiver bore having a lever end opening and an opposite, tool accessory end, the receiver bore comprising a reduced-diameter stop member adjacent the tool accessory end;

a split collet disposed within the receiver bore and configured for slidable movement within the receiver bore in either direction along the longitudinal axis thereof, the split collet having therein a shank groove which faces the tool accessory end of the receiver bore and defines at least two split segments of the split collet, the shank groove being configured to have a compressible section along at least a portion of the split segments and to receive therein a shank of a tool accessory at a selected position which is adjustable in infinitesimally small increments relative to the shank groove by sliding such shank along the shank groove; and an actuating member comprising (a) a locking lever mounted on the handle adjacent to the lever end opening of the receiver bore and (b) a resilient member disposed within the receiver bore between the lever end opening thereof and the split collet, the locking lever being movable between (i) a locked position in which the resilient member is compressed and forces the split collet against the stop member to thereby compress the compressible section to lock such knife blade in place within the handle and (ii) an unlocked position in which the resilient member is freed from such compression to permit movement of the split collet away from the stop member and thereby free such shank of such knife blade for movement relative to the handle, including disengagement from the handle.

17. The tool member of claim 16 wherein the split collet and the receiver bore are so configured that the movement of the split collet is a slidable movement, and the mounting of the locking lever is so configured that the locking lever is movable pivotably between the locked position and the unlocked position.

18. The tool member of claim 16 or claim 17 wherein the resilient member comprises a belleville spring.

19. The tool member of claim 18 wherein the split collet further comprises an extension stem on which is mounted a drive piston disposed within the receiver bore at the lever end opening thereof.

20. The tool member of claim 19 wherein the drive piston has an end face and the locking lever further comprises a cam which is disposed at the lever end opening of the receiver bore and when the locking lever is moved to the locked position the cam acts on the end face of the drive piston to drive the split collet into engagement with the stop member.

21. The tool member of claim 16 or claim 17 wherein the tool accessory comprises a knife blade having a shank and the knife blade is mounted by the shank on the tool member.

22. The tool member of claim 1 or claim 16 wherein the locking lever is pivotably movable between the locked position and the unlocked position.

23. The tool member of claim 1 or claim 16 wherein the receiver bore terminates at the accessory end of the handle in a knife slot which extends through the stop member, the knife slot being dimensioned to prevent entry therein of the split collet and to admit passage therethrough of such shank of a tool accessory for insertion into the shank groove of the split collet.

24. The tool member of claim 1 or claim 16 wherein the locking lever further comprises a cam which is disposed at the lever end opening and which is configured to apply pressure to drive and hold the split collet against the stop member when the locking lever is moved to the locked position, and to release the pressure to permit the split collet to move away from the stop member when the locking lever is moved to the unlocked position.

* * * * *